US007216420B2

(12) United States Patent
Tomita et al.

(10) Patent No.: US 7,216,420 B2
(45) Date of Patent: May 15, 2007

(54) METHOD OF MANUFACTURING PRINT HEAD

(75) Inventors: Manabu Tomita, Kanagawa (JP); Koichi Igarashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 127 days.

(21) Appl. No.: 10/393,200

(22) Filed: Mar. 20, 2003

(65) Prior Publication Data

US 2003/0179259 A1 Sep. 25, 2003

Related U.S. Application Data

(62) Division of application No. 10/052,820, filed on Nov. 7, 2001, now abandoned.

(30) Foreign Application Priority Data

Nov. 7, 2000 (JP) ..... P2000-344235

(51) Int. Cl.
*H05B 3/00* (2006.01)

(52) U.S. Cl. ..... 29/611; 29/25.35; 29/417; 29/424; 29/592.1; 29/856; 29/890.1; 156/155; 205/73; 205/75; 216/27; 347/20; 430/20

(58) Field of Classification Search ..... 29/611, 29/25.35, 417, 424, 592.1, 856, 890.1; 156/155; 205/73, 75; 216/27; 347/20; 430/20
See application file for complete search history.

(56) References Cited

U.S. PATENT DOCUMENTS 4,246,076 A * 1/1981 Gardner ..... 205/73
5,478,606 A * 12/1995 Ohkuma et al. ..... 427/555
5,916,452 A * 6/1999 Kobayashi et al. ..... 216/27
5,983,486 A * 11/1999 Shimomura et al. ..... 29/611

* cited by examiner

*Primary Examiner*—A. Dexter Tugbang
*Assistant Examiner*—Tim Phan
(74) *Attorney, Agent, or Firm*—Sonnenschein Nath & Rosenthal LLP

(57) ABSTRACT

A print head manufacturing method in which satisfactory precision can be obtained by simple processes are provided. Projecting objects having a predetermined shape are formed on a substrate, and a setting resin is applied on the substrate and is set. Then, the projecting objects are removed so that ink cells and nozzles are formed. The thickness of the setting resin is determined such that tip portions of the projecting objects project above the setting resin and ink cells can be formed.

5 Claims, 7 Drawing Sheets

METHOD OF MANUFACTURING PRINT HEAD

The present application claims priority to Japanese Application No. P20000-344235, filed Nov. 7, 2000, and is a divisional of U.S. application Ser. No. 10/052,820, filed Nov. 7, 2001, now abandoned, both of which are incorporated herein by reference to the extent permitted by law.

BACKGROUND OF THE INVENTION

1. Field of the Invention

The present invention relates to printers, print heads, and print head manufacturing methods. The present invention can be applied to a printer in which ink contained in ink cells is heated by heating elements so that ink drops are ejected from the ink cells.

2. Description of the Related Art

In ink jet printers, images, characters, etc., are printed by ejecting ink drops from small nozzles which then adhere to a print medium. In such ink jet printers, ink drops are ejected from small nozzles by heating ink with heating elements or by driving piezoelectric elements.

With respect to ink jet printers in which the ink drops are ejected by heating ink, a method of forming ink cells and nozzles on a substrate has been suggested in Japanese Unexamined Patent Application Publication No. 9-76516. According to this method, projecting objects having a predetermined shape are formed on the substrate at positions above heaters. Then, a setting resin is applied on the substrate and is set, and then the projecting objects are removed so that hollow parts are formed.

More specifically, in this method, heaters are first formed on a semiconductor substrate using semiconductor manufacturing techniques. Then, the projecting objects having the predetermined shape are formed above the heaters using photolithography techniques. The shape of the projecting objects is determined by the required shape of the hollow parts including the ink cells and the nozzles. Then, a setting resin such as epoxy resin, etc., is applied on the semiconductor substrate and is set. Then, the setting resin is partly removed so as to reveal the tip portions of the projecting objects, and then the projecting object are removed by dissolving them. Thus, hollow parts surrounded by the setting resin are formed, and ink passages, ink cells, and nozzles are formed on the semiconductor substrate. According to this method, the ink cells, etc., can be formed by simple processes.

However, in this method, there is a problem in that the nozzles cannot be formed with satisfactory precision.

In this method, the setting resin must be partly removed so as to reveal the tip portions of the projecting objects. However, in an etching process, which is a process for removing the setting resin, it takes approximately an hour to etch 10 μm. Accordingly, there is a problem in that a relatively long processing time is required. In addition, there is another problem in that side walls of ink outlets at the tips of the nozzles easily break, so that the ink drops may be ejected in different directions. In contrast, in barrel finishing, the setting resin can be partly removed and the tip portions of the projecting objects can be revealed in a relatively short time. However, in this case, since a large amount of side etching occurs, there is a problem in that the precision of the ink outlets at the tips of the nozzles is degraded.

SUMMARY OF THE INVENTION

Accordingly, in view of the above-described situation, an object of the present invention is to provide a printer, a print head, and a print head manufacturing method in which satisfactory precision can be obtained by simple processes.

In order to solve the above-described problems, a print head contained in a printer of the present invention or a print head of the present invention is manufactured by a manufacturing method including the steps of applying a setting resin on a substrate on which projecting objects are formed, the thickness of the setting resin being determined such that tip portions of the projecting objects which correspond to the nozzles project above the setting resin and that portions of the projecting objects which correspond to the ink cells are covered by the setting resin; setting the setting resin; and removing the projecting objects.

In addition, a print head manufacturing method according to the present invention includes the steps of applying a setting resin on a substrate on which projecting objects are formed, the thickness of the setting resin being determined such that tip portions of the projecting objects which correspond to the nozzles project above the setting resin and that portions of the projecting objects which correspond to the ink cells are covered by the setting resin; setting the setting resin; and removing the projecting objects.

According to the present invention, since the thickness of the setting resin is determined such that the tip portions of the projecting objects which correspond to the nozzles project above the setting resin and that portions of the projecting objects which correspond to the ink cells are covered by the setting resin, a process of removing the excessive resin can be omitted. Thus, degradation of the precision of the nozzles due to the process of removing the excessive resin can be prevented, and the processing time can be reduced. Accordingly, a satisfactory precision can be obtained by simple processes.

As described above, with a print head manufacturing method according to the present invention, a satisfactory precision can be obtained by simple processes.

DESCRIPTION OF THE PREFERRED EMBODIMENTS

Embodiments of the present invention will be described below with reference to the accompanying drawings.

First Embodiment

Figure 1A:
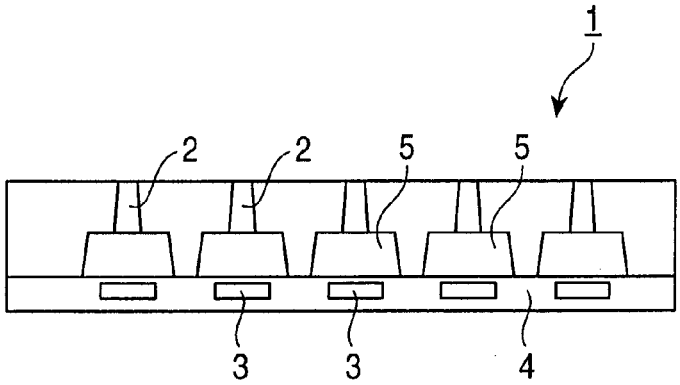
FIGS. 1A and 1B are sectional views of a print head according to a first embodiment of the present invention.
Figure 1B:
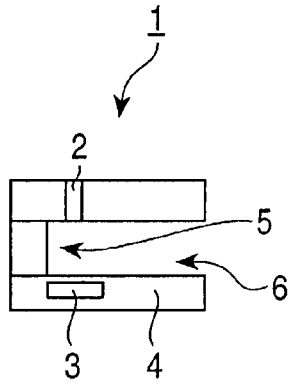

FIGS. 1A and 1B show a print head 1 included in a printer according to a first embodiment of the present invention. FIG. 1A is a sectional view of the print head 1 cut along a direction in which nozzles 2 are formed, and FIG. 1B is a sectional view of the print head 1 cut along a plane perpendicular to this direction. The print head 1 includes heaters 3, which serve as heating elements, transistors, which drive the heaters 3, and a semiconductor substrate 4, on which driving circuits for driving the transistors, etc., are integrated. The print head 1 is constructed by forming ink cells 5, ink passages 6, and the nozzles 2 on the semiconductor substrate 4. Ink is supplied to the ink cells 5, which are disposed above the heaters 3, via the ink passages 6, and ink drops are ejected from the ink cells 5 via the nozzles 2.

Figure 2A:
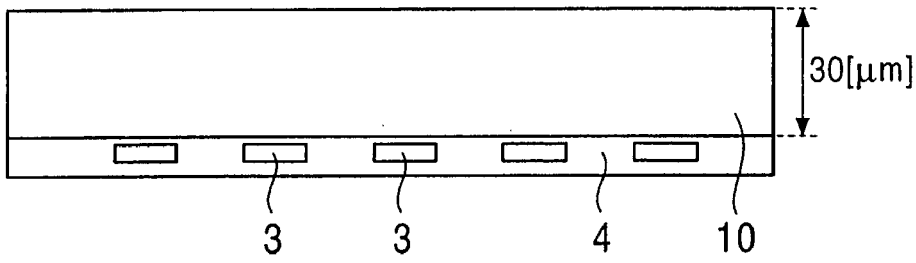
FIGS. 2A to 2F are sectional views showing processes of manufacturing the print head shown in FIGS. 1A and 1B.

In the first embodiment, as shown in FIG. 2A, which is a sectional view of an uncompleted print head as seen from the same direction as in FIG. 1A, the semiconductor substrate 4 is formed by using the techniques for manufacturing semiconductor integrated circuits. The print head 1 is formed on a wafer, and a layer of a photosensitive material 10 is formed on the semiconductor substrate 4 (FIG. 2A).

The semiconductor substrate 4 is first cleaned by exposing it to hexamethyldisilazane vapor for 90 seconds while it is heated to 120° C., and then a 30 μm thick layer of positive resist is applied on the semiconductor substrate 4 by spin coating. Then, the positive resist is pre-baked at 110° C. Accordingly, the layer of the photosensitive material 10 is formed. The positive resist is such that a part exposed to light becomes soluble in a certain solution. The layer of the photosensitive material 10 can also be formed by a method other than spin coating in accordance with requirements. The layer thickness (30 μm) is determined as the sum of the thickness corresponding to the distance from the surface of the semiconductor substrate 4 which faces the ink cells 5 to the outlets of the nozzles 2 and a predetermined amount of thickness. The predetermined amount of thickness is large enough so that tip portions of projecting objects 14, which will be described below, project above a setting resin.

Figure 2B:
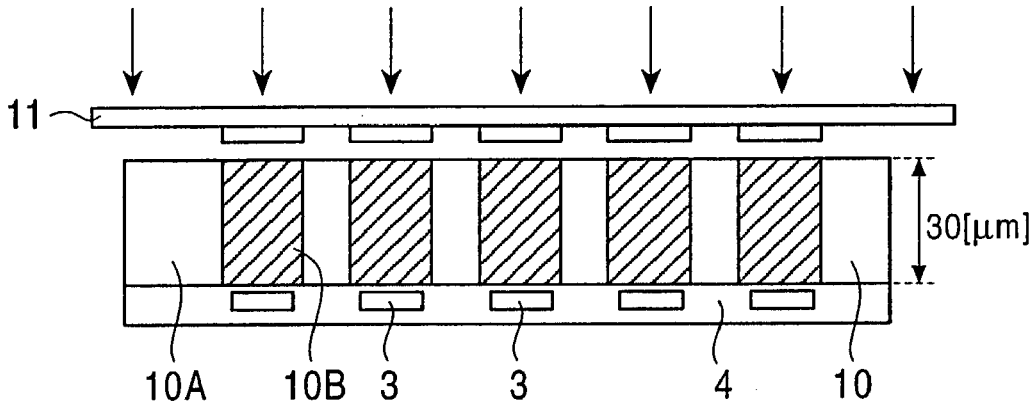

Then, in the first embodiment, as shown in FIG. 2B, an exposure process regarding regions corresponding to the ink cells 5 and the ink passages 6 is performed using a predetermined mask 11. Since the layer of the photosensitive material 10 is formed of the positive resist, when the mask 11 is seen from the nozzle side, the pattern of the mask 11 is made such that regions corresponding to the ink cells 5 and the ink passages 6 are prevented from being exposed. Accordingly, in this exposure process, regions 10B, that is, projections of the ink cells 5 and the ink passages 6 in the direction toward the nozzles 2, are not exposed and the remaining regions 10A are sufficiently exposed.

Figure 2C:
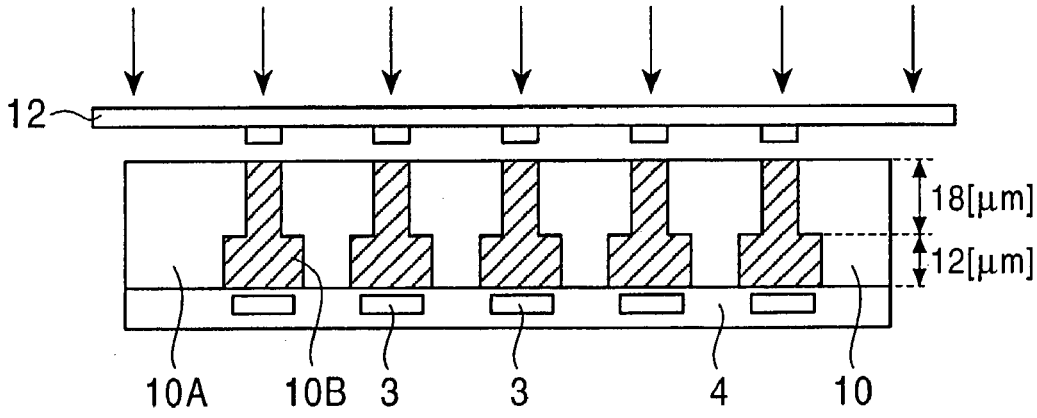

Then, in the first embodiment, as shown in FIG. 2C, another exposure process is performed using another mask 12. When the mask 12 is seen from the nozzle side, the pattern of the mask 12 is made such that regions corresponding to the nozzles 2 are prevented from being exposed. Accordingly, in this exposure process, regions 10B, that is, regions corresponding to the ink cells 5, the ink passages 6, and the nozzles 2, are not exposed and the remaining regions 10A are sufficiently exposed.

In the first embodiment, light intensity and exposure time are controlled such that the thickness of the portions of the unexposed regions 10B which correspond to the ink cells 5 and the ink passages 6 is 12 μm. Accordingly, the thickness of the portions of the unexposed regions 10B which correspond to the nozzles 2 is set to 18 μm, which is longer than a predetermined length of the nozzles 2 in the completed print head 1 (12 μm).

Figure 2D:
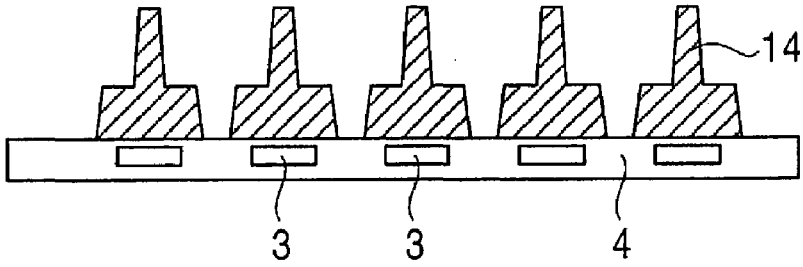
Figure 3:
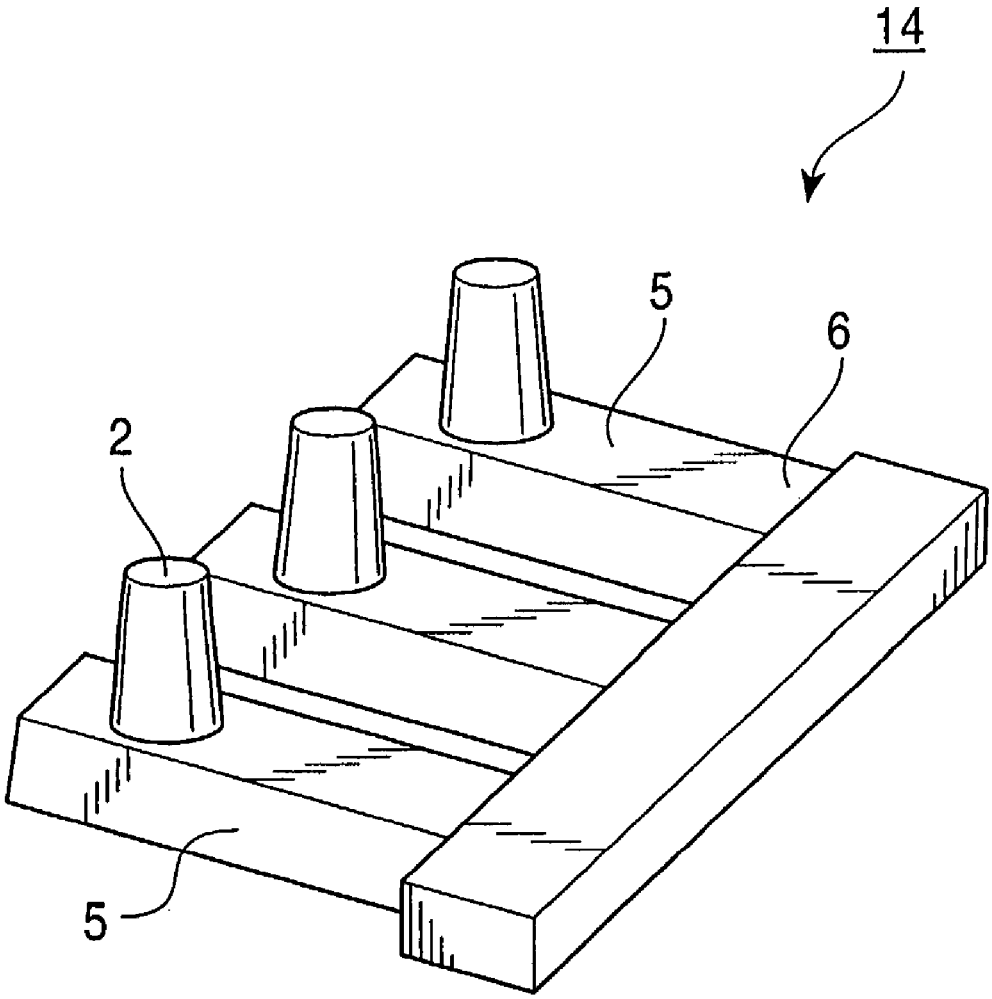
FIG. 3 is a perspective view of projecting objects formed by the processes shown in FIGS. 2A to 2D.

Then, as shown in FIGS. 2D and 3, the exposed regions 10A of the layer of the photosensitive material 10 are removed using a predetermined solution. Thus, the layer of the photosensitive material 10 is first formed on the semiconductor substrate 4, and then the exposure processes and a developing process of the photosensitive material is performed. Accordingly, projecting objects 14 having the same shape as hollow parts including the ink cells 5, the ink passages 6, and the nozzles 2 are formed at positions above the heaters 3. In FIG. 3, portions of the projecting objects 14 are denoted by the same reference numerals as the corresponding members (for example, portions corresponding to the nozzles are denoted by 2). In the first embodiment, an alkali solution including 2.38% tetramethylammonium hydroxide (TMAH) is used as the solution. However, other alkali solutions and inorganic alkali solutions may also be used.

Figure 2E:
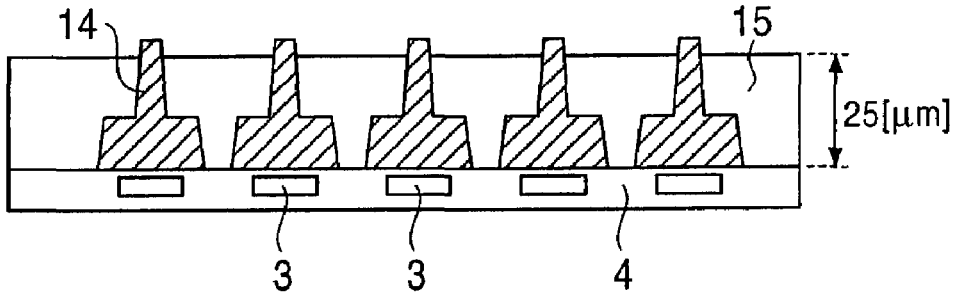

Then, according to the first embodiment, as shown in FIG. 2E, a predetermined setting resin 15 is applied and set. In the first embodiment, an ultraviolet setting epoxy resin is used as the setting resin 15. The thickness of the setting resin 15 is determined such that the tip portions of the projecting objects 14 project above the setting resin 15 and the portions of the projecting objects 14 corresponding to the ink cells 5 and the ink passages 6 are covered. In the first embodiment, the thickness of the setting resin 15 is set to 25 μm, so that the tip portions of the projecting objects 14 project above the surface of the setting resin 15 by 5 μm. The thickness of the setting resin 15 is adjusted by controlling the temperatures of the semiconductor substrate 4 and the setting resin 15, the rotational speed in a spin coating process, etc. The resist may be post-baked before this process, and the setting resin 15 may also be formed of a thermosetting epoxy resin, etc.

In the first embodiment, since the layer of the photosensitive material 10 is formed of a positive resist, the projecting objects 14 can be exposed in the setting process of the setting resin 15, so that the projecting objects 14 can be easily removed in the subsequent process.

Figure 2F:
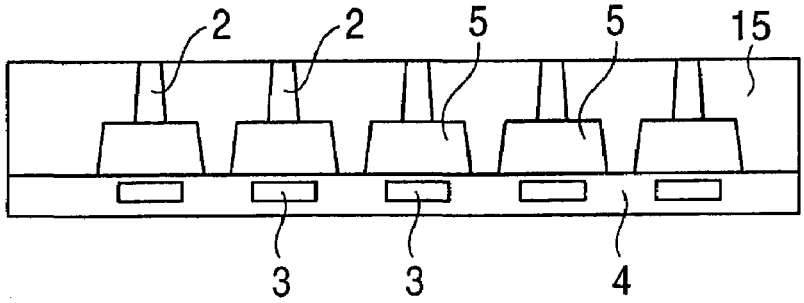

Then, according to the first embodiment, as shown in FIG. 2F, the projecting objects 14 are removed by a predetermined solution. Accordingly, the print head 1 is formed on the wafer. A plurality of print heads are obtained by breaking the wafer, and are transferred to an assembly line. Then, printers containing the print heads are fabricated.

Accordingly, in the first embodiment, a process of removing the excessive epoxy resin by barrel finishing, etching, etc., can be omitted. Thus, compared to the case in which the excessive resin is removed by etching, the processing time can be reduced and deterioration of the side walls of ink outlets can be prevented. In addition, compared to the case in which the excessive resin is removed by barrel finishing, degradation of the precision of the ink outlets can be prevented. Accordingly, a satisfactory precision can be obtained by simple processes.

In the first embodiment, an alkali solution including 0.38% tetramethylammonium hydroxide (TMAH), which is used also in the process of forming the projecting objects 14, is used as the solution for removing the projecting objects 14. Thus, the same material can be used in a plurality of processes, so that process control can be made simpler.

In addition, as described above, since an ultraviolet setting resin is used, the projecting objects 14 can be exposed in the setting process of the resin, so that the processes of manufacturing the print head can be made simpler.

According to the first embodiment, projecting objects having a predetermined shape are first formed on a substrate, and then a setting resin is applied on the substrate and is set. Then, the projecting objects are removed so that the ink cells and the nozzles are formed. Since the thickness of the setting resin is determined such that the tip portions of the projecting objects project above the setting resin and that ink cells can be formed, a satisfactory precision can be obtained by simple processes.

In addition, the projecting objects are formed by forming a layer of a photosensitive material on a substrate and performing the exposure processes and the developing process of the photosensitive material. Thus, by adequately choosing the setting resin and the photosensitive material, the projecting objects can be removed in the setting process of the resin. Accordingly, the processes of manufacturing the print head can be made simpler.

Second Embodiment

Figure 4A:
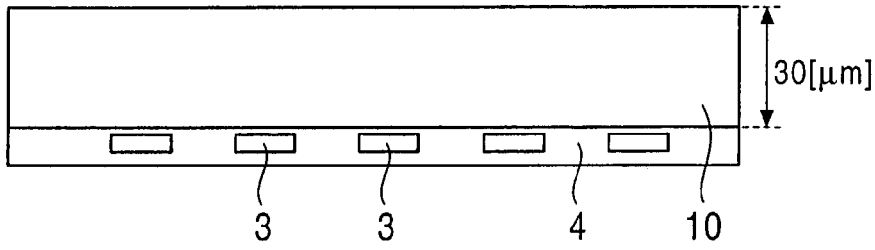
FIGS. 4A to 4C are sectional views showing processes of manufacturing a print head according to a second embodiment of the present invention.
Figure 4B:
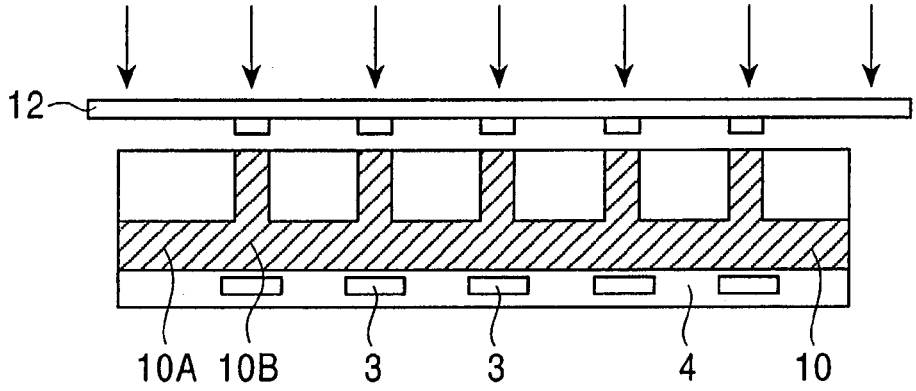
Figure 4C:
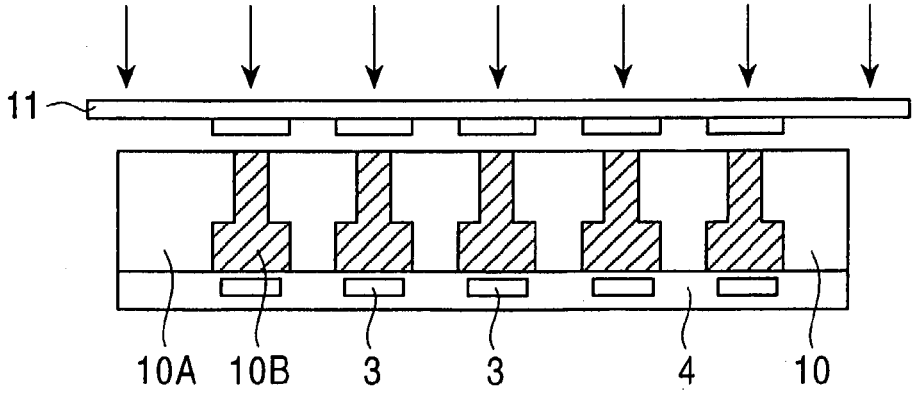

In a second embodiment, as shown in FIGS. 4A to 4C, the exposure processes described in the first embodiment are performed in the opposite order. Except for the point that the order of the exposure processes is opposite, the processes of manufacturing the print head according to the second embodiment are the same as those of the first embodiment. Thus, redundant explanations are omitted.

According to the second embodiment, the layer of the photosensitive material 10 is first exposed using the mask 12 having the pattern corresponding to the nozzles 2, and is then exposed using the mask 11 having the pattern corresponding to the ink cells 5 and the ink passages 6.

Also in this case, in which the exposure processes are performed in the opposite order, the effects obtained in the first embodiment can be obtained.

Third Embodiment

Figure 5A:
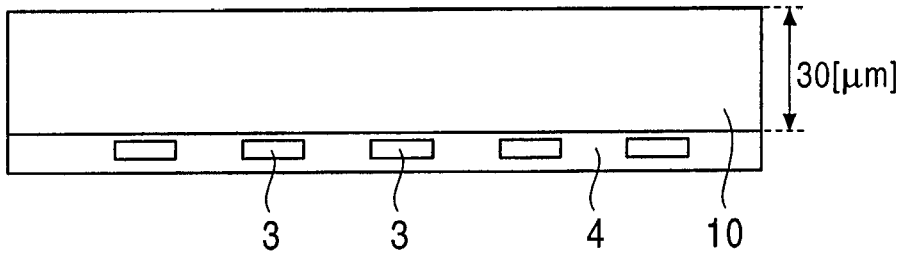
FIGS. 5A to 5G are sectional views showing processes of manufacturing a print head according to a third embodiment of the present invention.
Figure 5B:
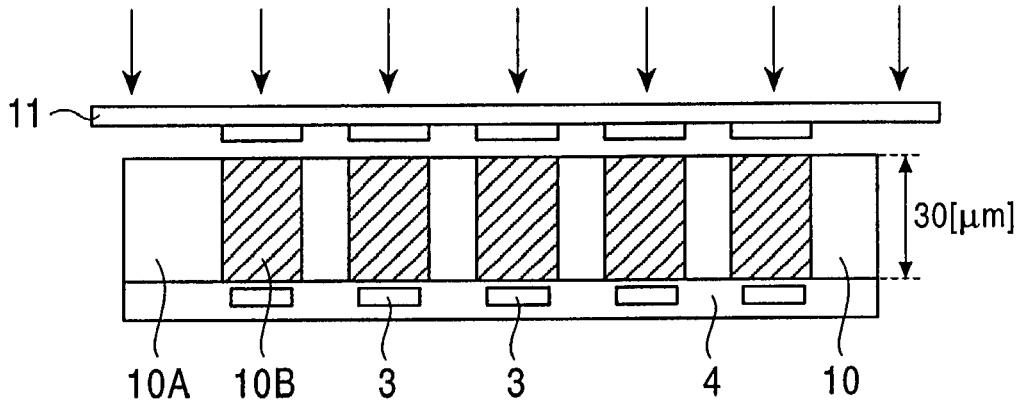
Figure 5C:
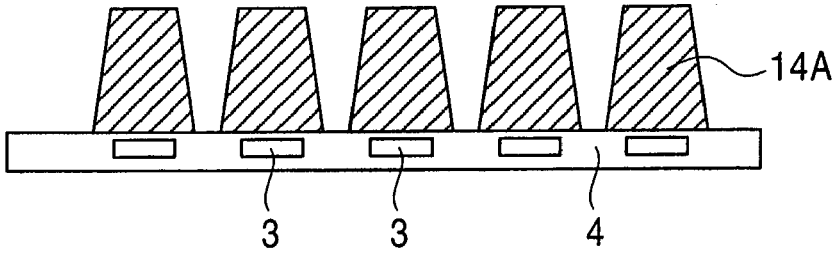
Figure 5D:
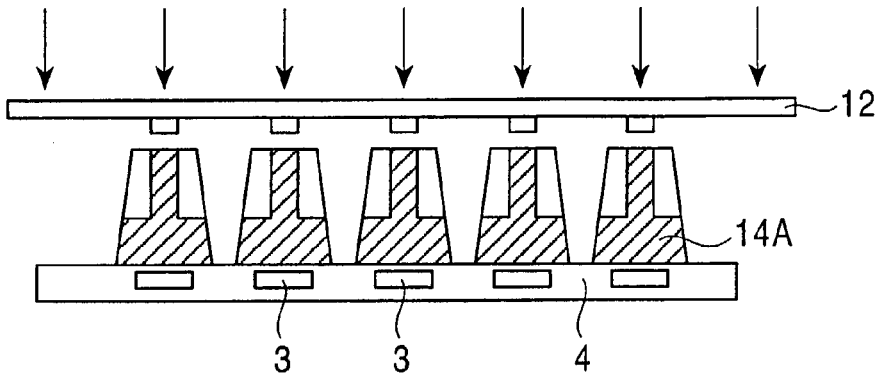
Figure 5E:
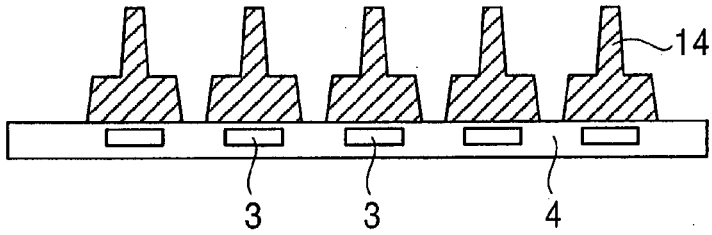
Figure 5F:
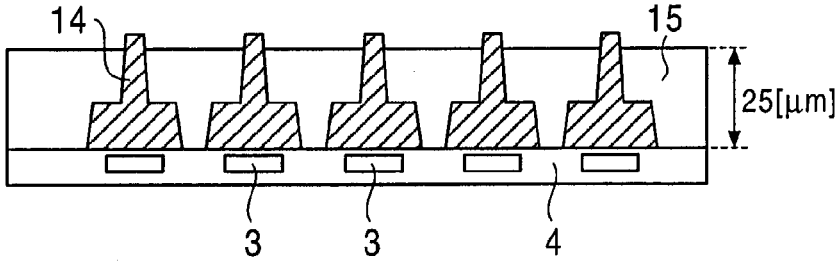
Figure 5G:
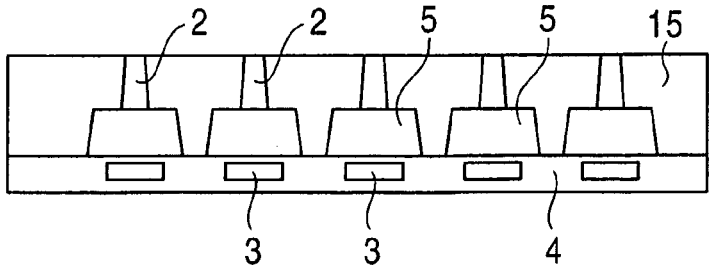

In the third embodiment, as shown in FIGS. 5A to 5G, after the first exposure process described in the first embodiment is performed (FIG. 5B), the photosensitive material is once developed. Thus, projecting objects 14A having a shape based on the required shape of the ink cells 5 and the ink passages 6 are formed (FIG. 5C). Then, the second exposure process is performed such that unexposed regions having a shape corresponding to the required shape of the nozzles 2 are formed (FIG. 5D), and then the developing process is performed again so that the projecting objects 14A are completed. Except for the exposure processes and the developing process, the processes of manufacturing the print head according to the third embodiment are the same as those of the first embodiment. Thus, redundant explanations are omitted.

Also in this case, in which the development process is performed each time the exposure process is performed, the effects obtained in the first embodiment can be obtained.

Modifications

Although a positive resist is used for forming the layer of a photosensitive material in the above-described embodiments, the present invention is not limited to this, and a negative resist can also be used so long as the mask patterns are inverted. In such a case, however, it is difficult to make the order of the exposure processes opposite in accordance with requirements.

What is claimed is:

1. A manufacturing method for a print head which ejects ink drops from nozzles by heating ink with heating elements, comprising the steps of:

forming projecting objects having the same shape as hollow parts corresponding to at least ink cells and the nozzles on a semiconductor substrate, on which the heating elements are disposed, at positions above the heating elements;

applying a setting resin on the semiconductor substrate on which the projecting objects are formed, the thickness of the setting resin being determined such that tip portions of the projecting objects which correspond to the nozzles project above the setting resin and that portions of the projecting objects which correspond to the ink cells are covered by the setting resin;

setting the setting resin; and removing the projecting objects.

2. A manufacturing method for the print head according to claim 1, wherein the step of forming the projecting objects comprises the steps of:

forming a layer of a photosensitive material on the substrate;

exposing the layer of the photosensitive material; and developing the layer of the photosensitive material so that the projecting objects remain.

3. A manufacturing method for the print head according to claim 2, wherein the step of exposing the layer of the photosensitive material comprises:

a first step in which regions corresponding to the ink cells are exposed; and a second step in which regions corresponding to the nozzles are exposed.

4. A manufacturing method for the print head according to claim 3, wherein a layer of photosensitive material is not formed between the first and second steps.

5. A manufacturing method for the print head according to claim 2, wherein a thickness of the photosensitive material is equal to that of a height of the projecting objects.

* * * * *